United States Patent [19]

Wiesler

[11] Patent Number: 5,021,013

[45] Date of Patent: Jun. 4, 1991

[54] BATTERY CABLE CONNECTOR

[76] Inventor: Dorothy Wiesler, 981 W. 18th St., Costa Mesa, Calif. 92629

[21] Appl. No.: 532,630

[22] Filed: Jun. 4, 1990

[51] Int. Cl.[5] ..... H01R 4/30

[52] U.S. Cl. ..... 439/755; 439/754; 439/801

[58] Field of Search ..... 439/754, 755, 765, 756, 439/757, 766, 768, 784, 801, 807; 411/388, 389, 397, 427; 429/179

[56] References Cited

U.S. PATENT DOCUMENTS

| | | | |
|---|---|---|---|
| 3,783,439 | 1/1974 | Valentino | 439/755 |
| 3,928,079 | 12/1975 | Jennings et al. | 439/765 X |
| 4,288,504 | 9/1981 | Julian et al. | 429/179 |
| 4,337,301 | 6/1982 | Rorer et al. | 429/179 |
| 4,425,414 | 1/1984 | Solomon | 429/179 |
| 4,435,486 | 3/1984 | Pomaro et al. | 429/1 |
| 4,455,357 | 6/1984 | Rorer et al. | 429/179 |
| 4,472,486 | 9/1984 | Orsino et al. | 429/179 |
| 4,482,618 | 11/1984 | Orsino et al. | 429/179 |
| 4,673,240 | 6/1987 | Byfield, Jr. | 439/755 |
| 4,936,799 | 6/1990 | Woodall | 439/755 |

FOREIGN PATENT DOCUMENTS 0463814 4/1974 Australia .

2216606 12/1972 Fed. Rep. of Germany .

*Primary Examiner*—Neil Abrams
*Assistant Examiner*—Khiem Nguyen
*Attorney, Agent, or Firm*—Edward E. Roberts

[57] ABSTRACT

A cable connection assembly which includes a screw or bolt member threadably receiving a nut member prior to insertion through the aperture of the battery cable and into the threaded aperture of the battery terminal. The nut member is withdrawn to a point adjacent the head of the bolt member. The bolt member is then passed through the cable aperture and hand tightened into the terminal aperture. Thereafter, in one embodiment, a first tool engages the bolt head and a second tool engages the nut, whereupon the nut is tightened against the washer cable end. In the process, the torsional force on the battery terminal is substantially eliminated, with the tightening of the nut, while maintaining the position of the bolt, placing a slight axial force on the terminal during connection. For disconnection, both tools are attached to the respective parts, and the nut is loosened while the bolt is maintained in position, resulting in no torsional force on the terminal. Alternatively, either or both of the nut member and bolt head may include wing members for enabling manual operation.

11 Claims, 1 Drawing Sheet

BATTERY CABLE CONNECTOR

BACKGROUND OF THE INVENTION

The background of the invention will be discussed in two parts.

Field of the Invention

This invention relates to battery cable connectors, and more particularly, to a battery cable connector for an automobile storage battery having a terminal with a threaded female aperture for connection of the cable thereto.

Description of the Prior Art

Lead-acid automobile storage batteries generally have terminals for electrical connection, via cable, to the electrical system of the vehicle. Some such batteries have battery posts, usualy top mounted, for connection to a clamping member of a battery cable. Other such batteries have side mounted terminals. For batteries with side mounted terminals, a pair of terminal members are encapsulated or encased within the storage battery housing or casing, with the terminal members being electrically conductive metallic material, with a boss portion having a central threaded aperture. Battery cables are connected to the terminals by means of bolt members which pass through apertured conductive washer head portions of the battery cables.

With either type battery, a significant percentage of the total causes of battery failure is attributable to excess stress on the storage battery terminal. With post type terminals and lead like clamp connectors, attachment and removal is sometimes accomplished with screwdrivers and pliers, and even hammers, which tends to displace the post from its axial orientation, thus inducing stress, and ultimately, internal electrical connection fatigue and breakage.

With side terminal batteries, after insertion of the bolt through the washer head portion of the battery cable, the bolt is inserted into the threaded aperture and tightened down. During this tightening, a wrench is normally employed and a torsional force is applied. In many instances, even though the bolt is snug, a mechanic, be it a home mechanic or professional mechanic, will apply an extra fraction of a turn. This torsional force is resisted only by the metal surrounding the threaded terminal aperture. In some instances, this terminal aperture is within a cylindrical boss member encapsulated in the housing. On loosening of the bolt member, a torsional force is applied in the reverse direction. These torsional forces are repeatedly applied in the forward and reverse direction as the battery cables are connected and disconnected over the life of the battery, thus resulting in metal fatigue at the terminal within the interior of the housing or casing.

The following patents have been uncovered in a search of prior art for the herein disclosed invention. U.S. Pat. No. 3,783,439, entitled "Battery Charger Adapter", issued on Jan. 1, 1974 to Valentino, and shows accessory means for attachment to a battery charging device.

U.S. Pat. No. 3,928,079, is entitled "Battery Cable with Detachably Retained Connector", and issued to Jennings et al on Dec, 23, 1975, such patent disclosing a cap device for protecting the cable form the elements with the cap device being retained by the cable.

Another device is shown and described in U.S. Pat. No. 4,288,504, entitled "Sealed Battery Cable Termination", such patent issuing to Julian et al, on Sept. 8, 1981, the disclosure being directed to the construction of an end of a battery cable.

Storage battery constructions are shown and described in U.S. Pat. No. 4,337,301, issued June 29, 1982 to Rorer et al, entitled "Aircraft Battery"; and U.S. Pat. No. 4,425,414, entitled "Battery", which issued to Solomon on Jan. 10, 1984.

U.S. Pat. No. 4,435,486, entitled "Quick Disconnect Battery Installation and Charging System", issued March 6, 1984, to Pomara et al, and shows a storage battery with a carrying strap, which battery may be lowered into a box-like housing.

U.S. Pat. No. 4,455,357, entitled "Housing Assembly for Aircraft Batteries", issued to Rorer et al on June 19, 1984, and discloses a battery construction.

U.S. Pat. No. 4,472,486, entitled "Terminal Support member", issued Sept. 18, 1984, and discloses a side terminal arrangement for receiving threaded members.

Terminal extender members are shown and described in U.S. Pat. No. 4,673,240, entitled "Side Mount Universal Battery Terminal", such patent being issued to Byfield, Jr. on June 16, 1987.

Another side terminal construction is disclosed in U.S. Pat. No. 4,482,618, entitled "Aircraft Battery", which issued to Orsino et al on Nov. 13, 1984.

German Patent No. 2,216,606 depicts a construction exemplary of the side terminal storage battery and depicts a battery cable attached thereto by a bolt engaging a threaded aperture in the battery terminal member.

Australian Patent No. 47,392, published April 11, 1974, is entitled "Improvements in Electrical Storage Batteries", and discloses a method for constructing a lead-acid storage battery with side terminals.

The foregoing batteries depict various methods and arrangements for battery terminals, and connections thereto. A primary concern with some of these patents is simply protecting the terminal once the cable is attached, or providing an extender, or showing a particular construction. In accordance with an aspect of the invention, it is accordingly an object of the invention to provide a new and improved cable connector arrangement for attaching a battery cable to a battery terminal having a threaded aperture.

SUMMARY OF THE INVENTION

The foregoing and other objects of the invention are accomplished by providing a cable connection assembly which includes a screw or bolt member threadably receiving a nut member prior to insertion through the aperture of the battery cable and into the threaded aperture of the battery terminal. The nut member is withdrawn to a point adjacent the head of the bolt member. The bolt member is then passed through the cable aperture and hand tightened into the terminal aperture. Thereafter, in one embodiment, a first tool engages the bolt head and a second tool engages the nut, whereupon the nut is tightened against the washer face of the cable end. In the process, the torsional force on the battery terminal is substantially eliminated, with the tightening of the nut, while maintaining the position of the bolt, placing a slight axial force on the terminal during connection. For disconnection, both tools are attached to the respective parts, and the nut is loosened while the bolt is maintained in position, resulting in no torsional force on the terminal. Alternatively, either or both of the nut member and bolt head may include wing members for enabling manual operation.

Other objects, features and advantages of the invention will become readily apparent from a reading of the specification, when taken in conjunction with the drawings, in which like reference numerals refer to like elements in the several views.

DESCRIPTION OF THE PREFERRED EMBODIMENT

Figure 1:
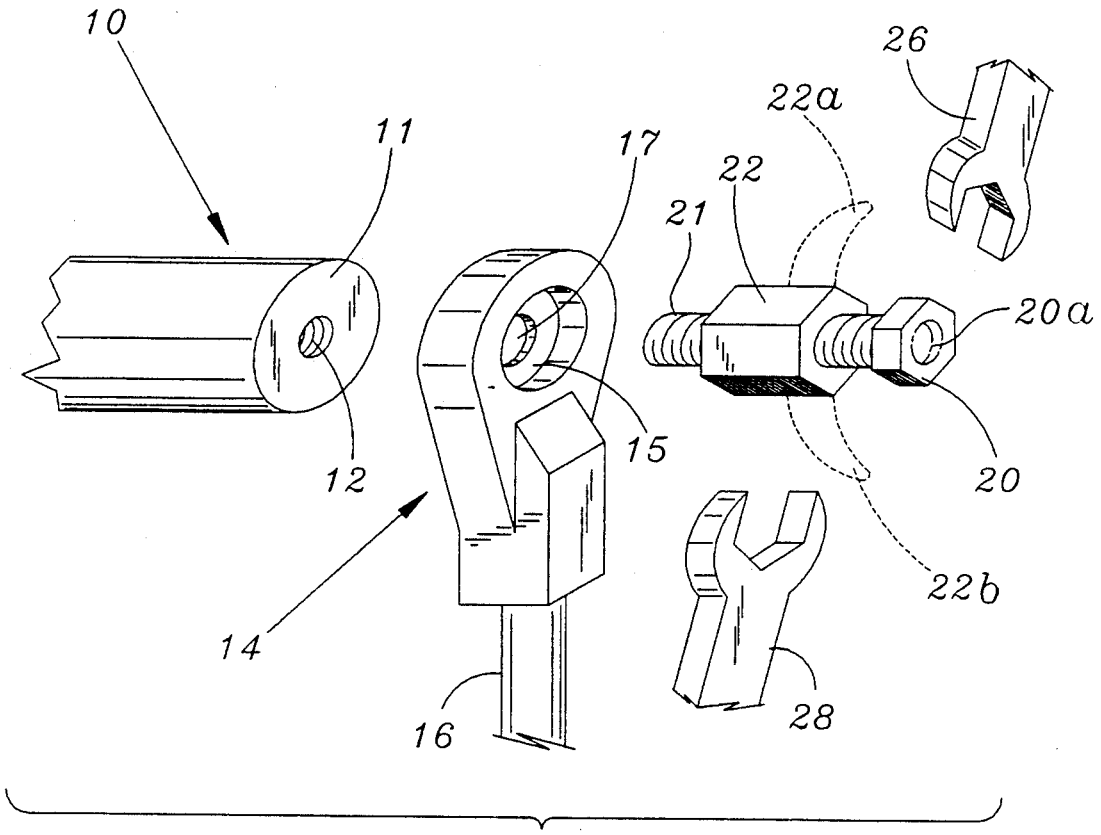
FIG. 1 is an exploded perspective view showing the battery cable connector arrangement according to the invention.

Referring now to the drawings, and particularly to FIG. 1, there is shown a perspective view of a battery terminal 10, a washer-shaped end 14 of a battery cable 16 and the battery cable connection arrangement including conductive bolt member 20, and nut member 22. The battery terminal 10 is molded into the normally thermoplastic material of the housing of the storage battery, with internal electrical connections (not shown) likewise encased in the material. The internal electrical connections are attached to the lead plates of the storage battery. In any event, the battery terminal 10 is formed of a conductive material and has a portion which may be generally cylindrical and has a face portion 11 which projects slightly beyond the adjacent side surface of the battery. A threaded aperture 12 is formed in the terminal for attachment of a battery cable coupler member thereto.

The battery cable 16 is a heavy gauge conductor with an insulation cover, such as rubber, polyethylene, or the like, with the end 14 including an aperture 17 formed within the enlarged conductive washer-shaped member, designated 15, which is usually surrounded by a peripheral collar of the same insulation material. With a conventional connector arrangement a bolt is inserted through the aperture 17 into engagement with the threaded aperture 12 of the terminal 10.

A wrench is used to engage the head of the bolt and the bolt is then tightened, thus applying torsional force to the washer-shaped end 15, which torsional force is transmitted to the face 11 of the terminal 10. To minimize the application of torsion, in some arrangements, the head of the bolt is small compared to the size of the threaded shaft portion, thereby requiring a smaller wrench, and thus, hopefully, limiting the amount of torsional force which may be applied to the terminal 10. This arrangement is shown in the above mentioned U.S. Pat. No. 3,928,079. With a reduced size bolt head, attachment of clamps to these head is very difficult, such as when jump starting the vehicle, or charging the battery thereof.

In accordance with the present battery connection arrangement, a bolt member 20 is provided, which may be provided with a conventional head or may be a cap screw, for engagement by an Allen type wrench. With a cap screw, a hexagonal recess, such as shown in broken lines 20*a*, is formed in the head of the bolt member 20. A nut member 22 is threaded onto the threaded shaft 21 of the bolt 20. The nut 22 may be a conventionally configured fastener member or may have an integrally formed flange or washer portion positioned for facing relation with the portion 15 of the battery cable 16. The shaft portion 21 of the bolt member 20 is of a length more than sufficient for receiving the nut member 22 thereon while permitting the portion 21 to he passed through the washer-shaped portion 15 into engagement with the aperture 12 of the terminal 10.

Figure 2:
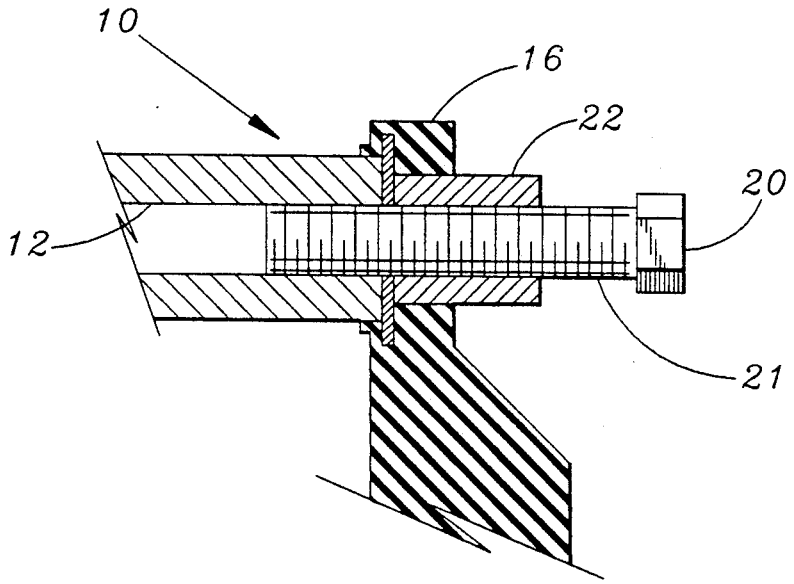
FIG. 2 is a cross-sectional view of the arrangement of FIG. 1 showing the connector attaching the cable to the battery terminal.

For attachment, the nut member 22 is hand threaded to a position proximate the head of the bolt 20, that is, it is threaded to the right as viewed in the drawings. Thereafter, as shown in FIG. 2, the shaft 21 of the bolt member 20 Is passed through the aperture 17 of the end 14 of the battery cable 16 into engagement with the threaded aperture 12 of the terminal 10. The bolt 20 is then hand threaded into the opening several turns. Then a first tool, such as wrench 26 is used to grasp the head of the bolt member 20, and a second wrench 28 is used to grasp the nut 22.

With the head of the bolt 20 maintained in a fixed position, the nut 22 is then rotated about the threaded shaft portion 21 of the bolt member 20 toward the face of the washer-shaped portion 15 of the battery cable 16. The tightening continues with the bolt 20 position held in fixed non-rotating relation to the battery terminal 10. Although there is a slight force applied to the face 12 of the terminal 10 as the washer-shaped member 15 is urged into contact therewith, this force is more of an axial force. That is, the resulting force is in the direction of the centerline of the aperture 12 and shaft 21 of the bolt member 20. This force of the nut 22 against the face 12 of the terminal 10 does not result in bending or twisting of the terminal 10, thereby prolonging the life of the battery.

As an alternative, the nut member 22 may be of the type known as a "wing nut", that is, a nut member having opposing laterally projecting integrally formed members which may be grasped by the fingers for tightening or loosening. These wings are depicted by broken lines in FIG. 1 as elements 22*a* and 22*b*.

For release of the connection, first and second tools, such as wrenches 26 and 28 are again used, with the bolt 20 held stationary and the nut 22 unthreaded to loosen the tension against the washer-shaped portion 15 of the battery cable 16. Thereafter the bolt 20 may be hand removed. With the wingnut member, the second wrench member 28 may be eliminated. In addition, the head of the bolt member 20 may likewise be provided with "wings" to enable a totally manually operable storage battery cable connector arrangement.

In any event, with the battery cable connection arrangement according to the invention, undue stress and fatigue on the terminal 10 are substantially minimized or eliminated, thereby precluding one of the major causes of battery failure. In addition, with the battery cable connection arrangement herein described, the end of the bolt 20 which protrudes from the side of the battery facilitates attachment of clamps from a battery charger.

While there has been shown and described a preferred embodiment, it is to be understood that various other adaptations and modifications may be made within the spirit and scope of the invention.

What is claimed is:

1. A battery cable connection arrangement for a battery having a terminal with a threaded aperture with the battery cable having a conductive end with aperture means for receiving a shaft of a bolt member therethrough, said arrangement comprising:

an at least partially electrically conductive bolt member having a head end and a threaded shaft portion for being received within the aperture of said terminal; and a nut member having a threaded aperture therethrough for being received on the shaft portion of said bolt member, said nut member being adapted for rotation on said shaft portion in first and second directions, rotation in said first direction resulting in relative displacement on said shaft portion toward the head end of said bolt member, rotation in the second direction resulting in relative displacement in the opposite direction on said shaft portion, said connector arrangement being utilized for connection of the battery cable with said nut member initially rotated in said first direction, and, upon insertion of said shaft portion through said aperture means of said battery cable into threaded engagement with the aperture of said terminal, said nut member is then rotated in said second direction with said bolt member held stationary for urging the conductive end of said cable toward said battery terminal under force of said nut member.

2. The battery cable connection arrangement according to claim 1 wherein said head end of said bolt member is configured for engagement with a tool for holding said bolt member stationary during rotation of said nut member in said second direction.

3. The battery cable connection arrangement according to claim 1 wherein said head end of said bolt member is configured for manual retention for holding said bolt member stationary during rotation of said nut member in said second direction.

4. The battery cable connection arrangement according to claim 1 wherein said nut member is configured for engagement with a tool for rotating said nut member in said second direction, while holding said bolt member stationary.

5. The battery cable connection arrangement according to claim 1 wherein said nut member is configured for manual rotation in said second direction while holding said bolt member stationary.

6. The battery cable connection arrangement according to claim 1 wherein said head end of said bolt member is configured for engagement by a first tool for holding said bolt member stationary during rotation of said nut member in said second direction, and wherein said nut member is configured for engagement by a second tool for rotating said nut member in said second direction, while holding said bolt member stationary.

7. The battery cable connection arrangement according to claim 1 wherein said head end of said bolt member is configured for engagement by a tool for holding said bolt member stationary during rotation of said nut member in said second direction, and wherein said nut member is configured for manual engagement for rotating said nut member in said second direction, while holding said bolt member stationary.

8. The battery cable connection arrangement according to claim 5 wherein said nut member is a wing nut.

9. In a method for connecting a battery cable having a conductive end with aperture means to a storage battery having a terminal with a threaded aperture, the method comprising:

providing a bolt member having a head end and a threaded shaft portion of a diameter sufficient to engage the threaded aperture;

providing a nut member having an aperture configured for threaded engagement with said shaft portion;

rotating said nut member in a first direction on said threaded shaft portion a given distance toward the head end of said bolt member;

inserting said threaded shaft through the aperture means of the conductive end of the battery cable;

manually threading said shaft portion several turns into the threaded aperture of the terminal;

rotating said nut member in a second direction opposite to the first direction while holding said bolt member from rotation for a distance sufficient to secure said battery cable to said terminal.

10. The method according to claim 9 wherein said step of holding said bolt member from rotation includes use of a tool engaging the head end of said bolt member.

11. The method according to claim 9 wherein said step of rotating said nut member while holding said bolt member from rotation includes use of a tool for engaging the head end of said bolt member and the use of a second tool for rotating said nut member.

* * * * *